US006012590A

United States Patent [19]

Sanchez

[11] Patent Number: 6,012,590

[45] Date of Patent: Jan. 11, 2000

[54] STRAND OF CHRISTMAS ORNAMENT HOOKS

[76] Inventor: Linda G. Sanchez, 451 Vasquez Ct. A, Sunnyvale, Calif. 94086

[21] Appl. No.: 09/109,707

[22] Filed: Jul. 2, 1998

[51] Int. Cl.[7] ..... A47F 5/00

[52] U.S. Cl. ..... 211/13.1; 211/86.01; 211/113

[58] Field of Search ..... 211/113, 118, 211/86.01, 85.2, 85.3, 119, 119.01, 119.1, 13.1; D8/372; D11/130

[56] References Cited

U.S. PATENT DOCUMENTS

| | | | |
|---|---|---|---|
| D. 369,292 | 4/1996 | Gary et al. | D11/130 X |
| D. 397,288 | 8/1998 | Johanson | D8/372 |
| 1,172,937 | 2/1916 | Butcher | 211/113 |
| 4,387,873 | 6/1983 | Pavlo et al. | 211/113 X |
| 5,285,908 | 2/1994 | Rogers | 211/118 |

*Primary Examiner*—Robert W. Gibson, Jr.

[57] ABSTRACT

A strand of christmas ornament hooks for winding around a Christmas tree to provide hooks for hanging ornaments thereon. The article includes an elongate filament having a pair of opposite ends with an end hook coupled to each end of the filament. A plurality of ornament hooks for suspending ornaments thereon are coupled to the filament.

18 Claims, 2 Drawing Sheets

STRAND OF CHRISTMAS ORNAMENT HOOKS

BACKGROUND OF THE INVENTION

1. Field of the Invention

The present invention relates to Christmas tree accessories and more particularly pertains to a new strand of Christmas ornament hooks for winding around a Christmas tree to provide hooks for hanging ornaments thereon.

2. Description of the Prior Art

The use of Christmas tree accessories is known in the prior art. More specifically, Christmas tree accessories heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,145,731; U.S. Pat. No. 5,523,130; U.S. Pat. No. 3,435,552; U.S. Pat. No. 2,352,631; U.S. Pat. No. Des. 331,360; and U.S. Pat. No. 4,729,187.

While these devices fulfill their respective, particular objectives and requirements, the aforementioned patents do not disclose a new strand of Christmas ornament hooks. The inventive device includes an elongate filament having a pair of opposite ends with an end hook coupled to each end of the filament. A plurality of ornament hooks for suspending ornaments thereon are coupled to the filament.

In these respects, the strand of Christmas ornament hooks according to the present invention substantially departs from the conventional concepts and designs of the prior art, and in so doing provides an apparatus primarily developed for the purpose of winding around a Christmas tree to provide hooks for hanging ornaments thereon.

SUMMARY OF THE INVENTION

In view of the foregoing disadvantages inherent in the known types of Christmas tree accessories now present in the prior art, the present invention provides a new strand of Christmas ornament hooks construction wherein the same can be utilized for winding around a Christmas tree to provide hooks for hanging ornaments thereon.

The general purpose of the present invention, which will be described subsequently in greater detail, is to provide a new strand of Christmas ornament hooks apparatus and method which has many of the advantages of the Christmas tree accessories mentioned heretofore and many novel features that result in a new strand of Christmas ornament hooks which is not anticipated, rendered obvious, suggested, or even implied by any of the prior art Christmas tree accessories, either alone or in any combination thereof.

To attain this, the present invention generally comprises an elongate filament having a pair of opposite ends with an end hook coupled to each end of the filament. A plurality of ornament hooks for suspending ornaments thereon are coupled to the filament.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new strand of Christmas ornament hooks apparatus and method which has many of the advantages of the Christmas tree accessories mentioned heretofore and many novel features that result in a new strand of Christmas ornament hooks which is not anticipated, rendered obvious, suggested, or even implied by any of the prior art Christmas tree accessories, either alone or in any combination thereof.

It is another object of the present invention to provide a new strand of Christmas ornament hooks which may be easily and efficiently manufactured and marketed.

It is a further object of the present invention to provide a new strand of Christmas ornament hooks which is of a durable and reliable construction.

An even further object of the present invention is to provide a new strand of Christmas ornament hooks which is susceptible of a low cost of manufacture with regard to both materials and labor, and which accordingly is then susceptible of low prices of sale to the consuming public, thereby making such strand of Christmas ornament hooks economically available to the buying public.

Still yet another object of the present invention is to provide a new strand of Christmas ornament hooks which provides in the apparatuses and methods of the prior art some of the advantages thereof, while simultaneously overcoming some of the disadvantages normally associated therewith.

Still another object of the present invention is to provide a new strand of Christmas ornament hooks for winding around a Christmas tree to provide hooks for hanging ornaments thereon.

Yet another object of the present invention is to provide a new strand of Christmas ornament hooks which includes an elongate filament having a pair of opposite ends with an end hook coupled to each end of the filament. A plurality of ornament hooks for suspending ornaments thereon are coupled to the filament.

Still yet another object of the present invention is to provide a new strand of Christmas ornament hooks that allows hanging of ornaments on a tree at generally equidistant intervals so that the ornaments are evenly distributed on the tree.

Even still another object of the present invention is to provide a new strand of Christmas ornament hooks that eliminates the need for a user to have separate hooks for hanging ornaments on a tree without having to fear about the hooks falling off of the tree and without the hassle of searching for hooks that may have fallen on the floor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 3:
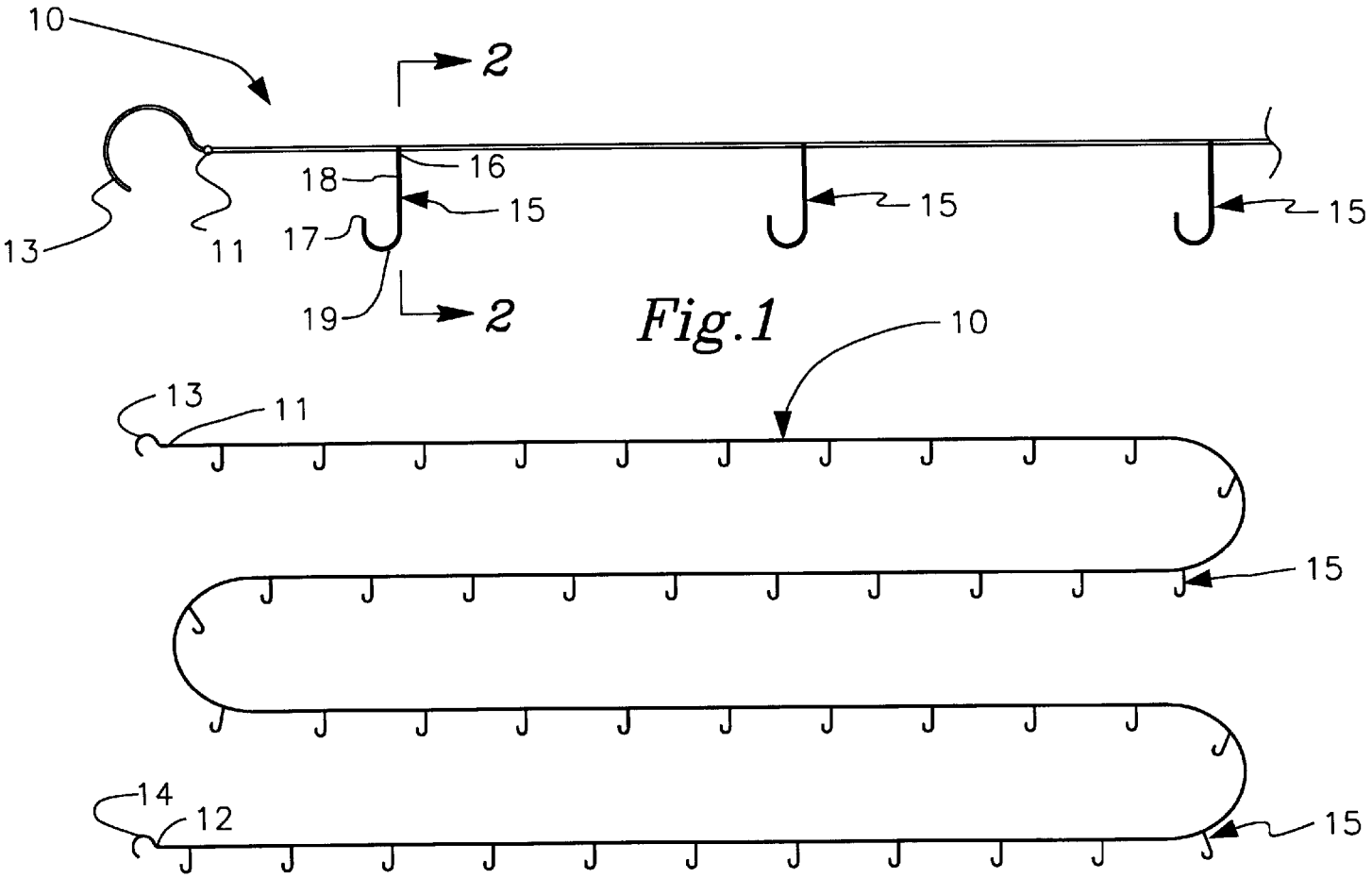
FIG. 1 is a schematic partial side view of one end of a new strand of Christmas ornament hooks according to the present invention.
FIG. 3 is a schematic side view of the present invention.
Figure 2:
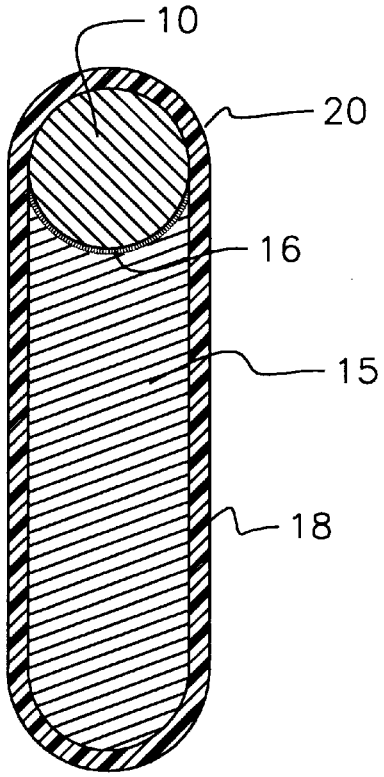
FIG. 2 is a schematic cross-sectional view of the present invention taken from line 2—2 of FIG. 1.
Figure 4:
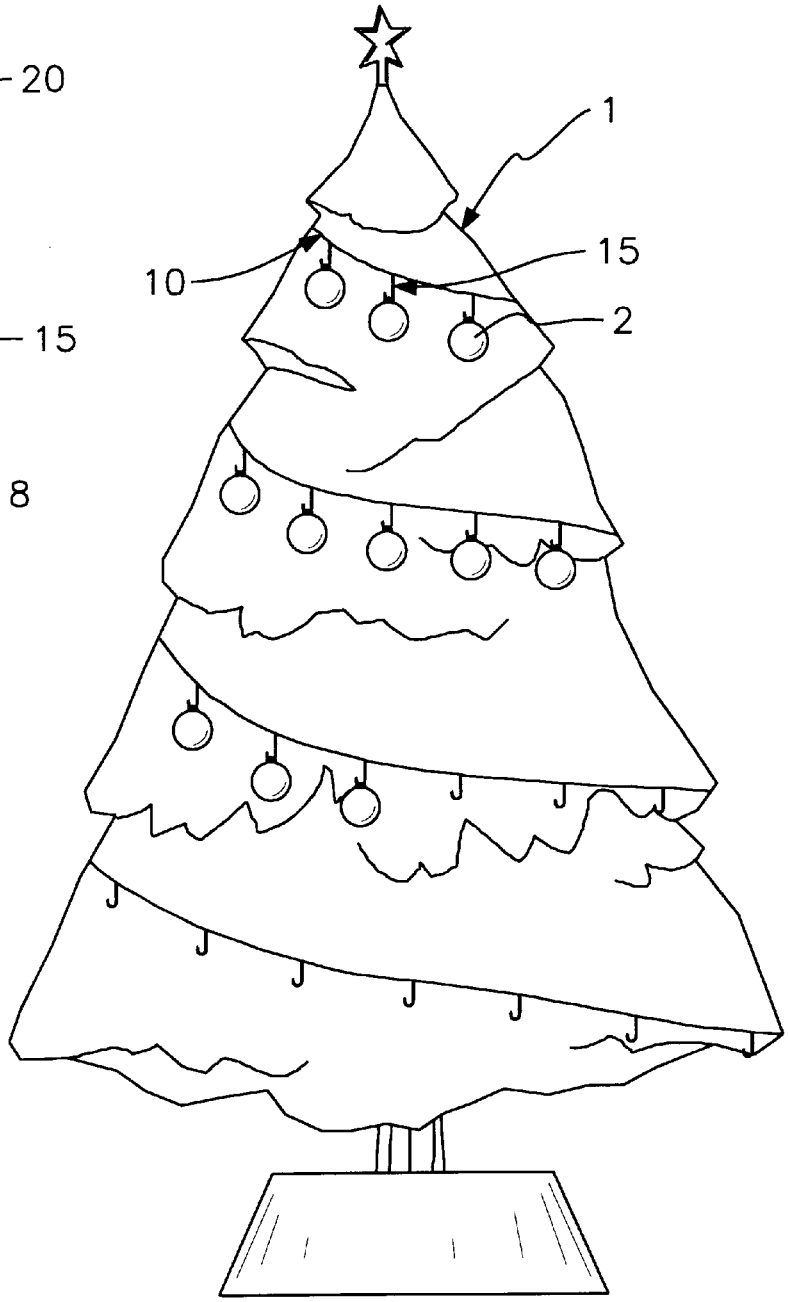
FIG. 4 is a schematic side view of the present invention in use draped on a tree and having ornaments hanging from the ornament hooks.

With reference now to the drawings, and in particular to FIGS. 1 through 4 thereof, a new strand of Christmas ornament hooks embodying the principles and concepts of the present invention will be described.

As best illustrated in FIGS. 1 through 4, the strand of christmas ornament hooks generally comprises an elongate filament 10 having a pair of opposite ends 11,12 with an end hook 13,14 coupled to each end of the filament 10. A plurality of ornament hooks 15 for suspending ornaments thereon are coupled to the filament 10.

In closer detail, the elongate filament 10 has a pair of opposite ends 11,12 and a longitudinal axis extending between the ends 11,12 of the filament 10. The filament 10 preferably has a generally circular cross section taken substantially perpendicular to the longitudinal axis of the filament 10. Also preferably, the filament 10 comprises a metal wire. Ideally, the filament 10 comprises a stainless steel wire. In use, the filament is draped around the tree and hung on the branches of the tree.

A pair of generally C-shaped end hooks 13,14 are also provided. One of the end hooks 13 is coupled to one end 11 of the filament 10 and the other end hook 14 is coupled to the other end 12 of the filament 10. Ideally, the end hooks 13,14 are welded to their associated end 11,12 of the filament 10. Optionally, the end hooks 13,14 may be pivotally coupled to their associated end 11,12 of the filament 10. In use, each of the end hooks 13,14 is designed for hooking on a portion of a tree 1 to hang their associated end 11,12 of the filament 10 to the tree 1.

Coupled to the filament 10 are a plurality of ornament hooks 15 for suspending ornaments 2 thereon. Each of the ornament hooks 15 is generally J-shaped and has a root end 16, a free end 17, an elongate portion 18, and an arcuate portion 19. The elongate portion 18 of each of the ornament hooks 15 is located adjacent the root end 16 of the ornament hook and the arcuate portion 19 of each of the ornament hooks 15 is located adjacent the free end 17 of the ornament hook. The elongate portion 18 and the arcuate portion 19 of each ornament hook preferably lie in a generally common plane. The root ends 16 of the ornament hooks 15 are coupled to the filament 10. Ideally, the root ends 16 of the ornament hooks 15 are welded to the filament 10. The elongate portion 18 of each of the ornament hooks 15 has a longitudinal axis extending generally perpendicular to the longitudinal axis of the filament 10. The ornament hooks 15 are preferably arranged along the filament 10 in a row extending between the ends 11,12 of the filament 10 with the ornament hooks 15 preferably spaced apart in generally equal intervals in the row.

Ideally, an protective outer coating 20 is provided over the filament 10, the end hooks 13,14, and the ornament hooks 15. Ideally, the outer coating 20 comprises a polytetrafluoroethylene polymer such as Teflon.

Ideally, the filament 10 has a diameter across its cross section of about 0.025 inches. The filament 10 has a length defined between the ends 11,12 of the filament 10. Ideally, for a tree 1 having a height between 5 and 6 feet, the length of the filament 10 is about 36 inches and the interval between adjacent ornament hooks 15 is between about 3 inches and about 4 inches. Ideally, for a tree 1 having a height between 2 and 3 feet, the length of the filament 10 is about 18 inches and the interval between adjacent ornament hooks 15 is between about 2 inches and about 3 inches. Ideally, for a tree 1 having a height greater than 6 feet, the length of the filament 10 is greater than about 36 inches and the interval between adjacent ornament hooks 15 is between about 6 inches and about 7 inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, arc deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An article for hanging ornaments on a tree, said article comprising:

an elongate filament having a pair of opposite ends;

a pair of end hooks, one of said end hooks being coupled to one end of said filament, another of said end hooks being coupled to another end of said filament, each of said end hooks being for hooking on a portion of a tree to hang the associated end of said filament to the tree;

a plurality of ornament hooks for suspending ornaments thereon, said ornament hooks being coupled to said filament; and wherein said filament comprises a metal wire.

2. The article of claim 1, wherein said filament has a longitudinal axis extending between said ends of said filament, wherein said filament has a generally circular cross section taken substantially perpendicular to said longitudinal axis of said filament.

3. The article of claim 1, wherein said filament comprises a stainless steel wire.

4. The article of claim 1, wherein each of said ornament hooks is generally J-shaped and has a root end, a free end, an elongate portion, and an arcuate portion, wherein said elongate portion of each of said ornament hooks is located adjacent said root end of said ornament hook, wherein said arcuate portion of each of said ornament hooks is located adjacent said free end of said ornament hook, and wherein said root ends of said ornament hooks are coupled to said filament.

5. The article of claim 4, wherein said filament has a longitudinal axis extending between said ends of said filament, wherein said elongate portion of each of said ornament hooks has a longitudinal axis extending generally perpendicular to said longitudinal axis of said filament.

6. The article of claim 1, wherein said ornament hooks are arranged along said filament in a row extending between said ends of said filament, said ornament hooks being spaced apart in said row in generally equal intervals.

7. The article of claim 6, wherein said filament has a length defined between said ends of said filament, wherein said length of said filament is about 36 inches, and wherein said interval between ornament hooks is between about 3 inches and about 4 inches.

8. The article of claim 6, wherein said filament has a length defined between said ends of said filament, wherein said length of said filament is about 18 inches, and wherein said interval between ornament hooks is between about 2 inches and about 3 inches.

9. The article of claim 6, wherein said filament has a length defined between said ends of said filament, wherein said length of said filament is greater than about 36 inches, and wherein said interval between ornament hooks is between about 6 inches and about 7 inches.

10. The article of claim 1, further comprising an protective outer coating being provided over said filament, said end hooks, and said ornament hooks.

11. The article of claim 10, wherein said outer coating comprises a polytetrafluoroethylene polymer.

12. An article for hanging ornaments on a tree, said article comprising:

an elongate filament having a pair of opposite ends and a longitudinal axis extending between said ends of said filament;

said filament having a generally circular cross section taken substantially perpendicular to said longitudinal axis of said filament;

wherein said filament comprises a stainless steel wire;

a pair of generally C-shaped end hooks, one of said end hooks being coupled to one end of said filament, another of said end hooks being coupled to another end of said filament, wherein said end hooks are welded to the associated end of said filament, each of said end hooks being for hooking on a portion of a tree to hang the associated end of said filament to the tree;

a plurality of ornament hooks for suspending ornaments thereon, each of said ornament hooks being generally J-shaped and having a root end, a free end, an elongate portion, and an arcuate portion;

said elongate portion of each of said ornament hooks being located adjacent said root end of said ornament hook, said arcuate portion of each of said ornament hooks being located adjacent said free end of said ornament hook;

said root ends of said ornament hooks being coupled to said filament, wherein said root ends of said ornament hooks are welded to said filament, said elongate portion of each of said ornament hooks having a longitudinal axis extending generally perpendicular to said longitudinal axis of said filament;

said ornament hooks being arranged along said filament in a row extending between said ends of said filament, said ornament hooks being spaced apart in said row in generally equal intervals; and an protective outer coating being provided over said filament, said end hooks, and said ornament hooks, wherein said outer coating comprises a polytetrafluoroethylene polymer.

13. An article for hanging ornaments on a tree, said article comprising:

an elongate filament having a pair of opposite ends;

a pair of end hooks, one of said end hooks being coupled to one end of said filament, another of said end hooks being coupled to another end of said filament, each of said end hooks being for hooking on a portion of a tree to hang the associated end of said filament to the tree;

a plurality of ornament hooks for suspending ornaments thereon, said ornament hooks being coupled to said filament; and a protective outer coating being provided over said filament, said end hooks, and said ornament hooks.

14. The article of claim 13, wherein said filament has a longitudinal axis extending between said ends of said filament, wherein said filament has a generally circular cross section taken substantially perpendicular to said longitudinal axis of said filament.

15. The article of claim 13, wherein said filament comprises a metal wire.

16. The article of claim 13, wherein said filament comprises a stainless steel wire.

17. The article of claim 13, wherein each of said ornament hooks is generally J-shaped and has a root end, a free end, an elongate portion, and an arcuate portion, wherein said elongate portion of each of said ornament hooks is located adjacent said root end of said ornament hook, wherein said arcuate portion of each of said ornament hooks is located adjacent said free end of said ornament hook, and wherein said root ends of said ornament hooks are coupled to said filament.

18. The article of claim 13, wherein said filament has a longitudinal axis extending between said ends of said filament, wherein said elongate portion of each of said ornament hooks has a longitudinal axis extending generally perpendicular to said longitudinal axis of said filament.

* * * * *